US008695276B2

(12) United States Patent
Zhang et al.

(10) Patent No.: US 8,695,276 B2
(45) Date of Patent: Apr. 15, 2014

(54) TURNSTILE BLOCKING APPARATUS WITH ADJUSTABLE BLOCKING WIDTH OF GATE LEAF

(75) Inventors: Liang Zhang, Shanghai (CN); Qiying Gu, Shanghai (CN); Genfang Xie, Shanghai (CN)

(73) Assignee: Shanghai Huaming Intelligent Terminal Equipment Co., Ltd, Shanghai (CN)

( * ) Notice: Subject to any disclaimer, the term of this patent is extended or adjusted under 35 U.S.C. 154(b) by 0 days.

(21) Appl. No.: 13/703,885

(22) PCT Filed: Feb. 14, 2011

(86) PCT No.: PCT/CN2011/000229

§ 371 (c)(1),
(2), (4) Date: Dec. 12, 2012

(87) PCT Pub. No.: WO2012/079271

PCT Pub. Date: Jun. 21, 2012

(65) Prior Publication Data

US 2013/0269260 A1 Oct. 17, 2013

(30) Foreign Application Priority Data

Dec. 17, 2010 (CN) ..... 2010 1 0597007

(51) Int. Cl.
*E01F 13/00* (2006.01)

(52) U.S. Cl.
USPC ..... 49/49; 404/6; 246/125; 246/127

(58) Field of Classification Search
USPC ..... 49/49; 404/6; 246/125, 127, 473.1, 292, 246/293
See application file for complete search history.

(56) References Cited

U.S. PATENT DOCUMENTS

| | | | | |
|---|---|---|---|---|
| 6,241,300 | B1 * | 6/2001 | Suzuki | 296/37.8 |
| 8,020,603 | B2 * | 9/2011 | Burgin | 160/134 |
| 2007/0237577 | A1 * | 10/2007 | Gelfand et al. | 404/6 |
| 2009/0116903 | A1 * | 5/2009 | Causey et al. | 404/6 |

FOREIGN PATENT DOCUMENTS

| | | | |
|---|---|---|---|
| CN | 201037352 Y | * | 3/2008 |
| CN | 201110102 Y | * | 9/2008 |

* cited by examiner

*Primary Examiner* — Katherine Mitchell
*Assistant Examiner* — Marcus Menezes
(74) *Attorney, Agent, or Firm* — CBM Patent Consulting, LLC

(57) ABSTRACT

The invention discloses a scissor-type gate blocking apparatus with an adjustable blocking width of a gate leaf. According to its technical solutions, the apparatus comprises a shaft 1 and an initiative swing arm 4. It also comprises an eccentric disk 21 connected with the shaft 1 and eccentrically provided with a plurality of mounted holes 211 of the eccentric disk 21, an eccentric amount adjusting piece 22 connected with the eccentric disk 21 through the mounted hole 211 of the eccentric disk 21, a small shaft 223 eccentrically fixed at the eccentric amount adjusting piece 22, and a connecting rod mechanism adjusting its length retractably and connected with the initiative swing arm 4. The blocking apparatus has the advantages that it has a simple and practical structure and can adjust the blocking width of the gate leaf within a certain range.

4 Claims, 6 Drawing Sheets

TURNSTILE BLOCKING APPARATUS WITH ADJUSTABLE BLOCKING WIDTH OF GATE LEAF

TECHNICAL FIELD OF THE INVENTION

The invention relates to a turnstile blocking apparatus, in particular to a transmission connecting mechanism positioned between a drive apparatus and a gate leaf swing arm.

TECHNICAL BACKGROUND OF THE INVENTION

Rail transit stations, such as transit stations of subways, light railways, railroads and so on, generally establish an automatic fare gate to control passengers and cargos. A turnstile blocking apparatus belongs to one kind of the automatic fare gate.

The width of a passage of the turnstile blocking apparatus is determined by the width of a gate leaf functioning as blocking when the leaf is closed. The transmission connecting mechanism, driving the gate leaf to be opened or closed and positioned between the drive apparatus and the swing arm of the gate leaf, determines the blocking amplitude of the gate leaf. Currently, the disclosed transmission connecting mechanism between the drive apparatus and the swing arm of the gate leaf has the following several categories: According to publication patent number CN201053282 of "Turnstile Structure for Fare Gate" a gate is opened and closed with the adoption of a connecting crank—swing rod transmission mechanism between a motor and a gate leaf; according to publication patent number CN2635850 of "Control Apparatus of Access Gate of Gate leaf" a motor is adopted to drive an eccentric transmission disk driving a traction plate connecting a swing arm of a gate leaf, thereby opening or closing the gate leaf; according to publication patent number CN201037352 of "Turnstile for Automatic Fare Gate", a motor drives an eccentric disk driving a connecting rod to draw a swing arm, so as to open or close a gate leaf. The transmission connecting apparatus in the abovementioned prior art mainly consists of an eccentric disk or a crank and a connecting rod playing the same role or a traction plate and a swing rod playing the same role. However, either the eccentric amount of the eccentric disk or the length of the connecting rod is a constant value and cannot be adjusted, thereby determining that the blocking amplitude of the gate leaf is not a constant value. If the width of a passage needs to be adjusted, the transmission connecting mechanism consisting of an eccentric disk with other eccentric amount and the connecting rod with other length must be replaced, thus costing manpower and material resources and being adverse to fully utilize equipment.

SUMMARY OF THE INVENTION

As for the abovementioned technical problems, the invention provides the following technical solutions: a transmission connecting mechanism adjusting the length of a connecting rod and the eccentric amount of an eccentric disk is provided, so as to achieve a turnstile blocking apparatus adjusting the blocking width of a gate leaf within a certain range. The adopted technical solutions, solving the abovementioned technical problems, are as follows: The apparatus comprises a shaft 1 and swing arm 4, wherein it also comprises an eccentric disk 21 connected with the shaft 1 and eccentrically provided with a plurality of mounting holes 211 of the eccentric disk 21, an eccentric adjusting piece 22 connected with the eccentric disk 21 through the mounting hole 211 of the eccentric disk 21, a small shaft 223 eccentrically fixed at the eccentric adjusting piece 22, and a connecting rod mechanism 3 adjusting its length retractably and is connected with the swing arm 4.

The invention has the following technical effects: the eccentric disk in the prior art is directly with the small shaft 223 together, and the small shaft 223 is freely connected with the connecting rod again. Under such conditions, the eccentric amount of the small shaft 223 relative to the eccentric disk 21 is unchanged. The eccentric adjusting piece 22, fixing the small shaft 223, is additionally provided on the eccentric disk. The small shaft 223 then is freely connected with the connecting rod. A plurality of the mounting holes, adjusting the eccentricity, are arranged on the eccentric disk 21. The eccentric adjusting piece 22 can be rotated conveniently and then arranged in the corresponding mounting holes, thus realizing the function of adjusting the eccentricity. The length of the connecting rod must be adjusted after the eccentric amount is adjusted. The connecting rod in the prior art does not have stretching function. The connecting rod mechanism 3 in the invention can retractably adjust the length of the connecting rod. Through the abovementioned arrangement, the blocking width of the gate leaf can be increased or decreased within a certain range while the gate leaf is guaranteed to be completely opened or recovered in place.

One of the preferable solutions in the invention is as follows: The eccentric disk 21 is eccentrically provided with six mounting holes 211 of the eccentric disk positioned at the same periphery and distributed uniformly.

The preferable technical solution further has the following technical effects: Six mounting holes 211 having the inclined angle of 60° are uniformly and eccentrically provided at the eccentric disk 21. The eccentric adjusting piece 22 is only rotated by 60° and can change the eccentricity. Therefore, there is relatively big room to adjust the eccentric amount so that the eccentric amount can be better matched with the changed length of the connecting rod.

One of the preferable technical solutions of the invention is as follows: The eccentric adjusting piece 22 is a flange, and three flange mounting holes 222 are provided on the flange. The flange mounting holes 222 are uniformly distributed and corresponding to the mounting holes 211 of the eccentric disk.

The preferable technical solution further has following technical effects: The eccentric disk 21 in the prior art is directly welded with the small shaft 223 together, and thus the eccentric amount cannot be adjusted. The invention is additionally provided with the flange and eccentrically provided with the small shaft 223; there is one eccentric amount between the small shaft 223 and the central point of the flange. The flange is in bolted connection with the eccentric disk 21 through the mounting holes. Therefore, only when the mounted place between the flange and the eccentric disk 21 is changed, the eccentric amount can be conveniently changed.

One of the preferable technical solutions of the invention is as follows: The connecting rod 3 comprises an adjusting nut 31 having the left and the right ends respectively provided with a left thread and a right thread, the traction rod (32) of the left thread having one end connected with the left thread of the adjusting nut (31) and having the other end connected with the swing arm (4) of a gate leaf, and. the traction rod (33) of the right thread having one end connected with the right thread of the adjusting nut (31) and having the other end connected with the eccentric adjusting piece 22.

One of the preferable technical solutions of the invention is as follows: A connecting rod mechanism 3 in the invention is connected with a left traction rod and a right traction rod 32 and 33 as well as adjusting nut 31 through a thread. Only when the adjusting nut 31 is rotated, the traction rods 32 and 33 of the left and the right threads can be moved relatively, thus realizing the functions that the connecting rod can be stretched and its length can hence be adjusted.

One of the preferable technical solutions of the invention is as follows: A connecting rod mechanism 3 further comprises a left lock nut 34 arranged between a traction rod 32 of a left thread and an adjusting nut 31 and a right lock nut 35 arranged between a traction rod 33 of a right thread and the adjusting nut 31.

The preferable technical solution further has follows technical effects: The right and the left lock nuts 34 and 35 are arranged between the traction rods 32 and 33 of the left and the right threads and the adjusting nut 31. After the connecting rod is adjusted, the lock nut is rotated tightly again, so that the traction rod and the adjusting nut are connected more firmly and stably, thereby preventing their parts from being displaced.

One of the preferable technical solutions of the invention is as follows: swing arm 4 is fixed with a traction shaft 41; the traction rod 32 of the left thread is fixed with a left bearing 36 sleeved with the traction shaft 41, thereby facilitating the traction rod 32 of the left thread to be freely connected with the swing arm 4. The traction rod 33 of the right thread is fixed with a right bearing 37 sleeved with the small shaft 223, thereby facilitating the traction rod 33 of the right thread to be freely connected with the eccentric adjusting piece 22.

The preferable technical solutions further have the following technical effects: The connecting rod as well as the swing arm and the small shaft are freely connected with bearings, thereby facilitating the operation between the parts to be matched with each other more smoothly and facilitating vibration to be lowered.

DRAWINGS OF THE INVENTION

1. Shaft;
3. Connecting Rod Mechanism;
4. Swing Arm
5. Gate leaf
6. Motor
7. Worm Speed Reducer
8. Rotation Shaft
9. Driven Swing Arm
10. Electromagnet
21. Eccentric Disk
22. Eccentric adjusting piece
31. Adjusting Nut
32. Traction Rod of Left Thread
33. Traction Rod of Right Thread
34. Left Lock Nut
35. Right Lock Nut
36. Right Bearing
37. Right Bearing
41. Traction Shaft
211. Mounting Hole of Eccentric Disk
212. Mounted Base
222. Flange Mounting Hole
223. Small Shaft

EMBODIMENTS OF THE INVENTION

Figure 1:
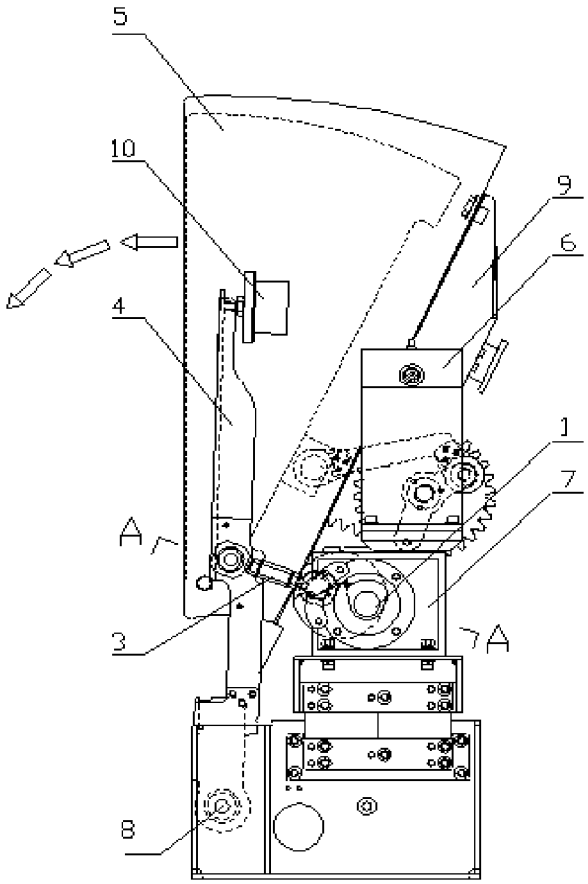
FIG. 1 is a front view of the invention.
Figure 2:
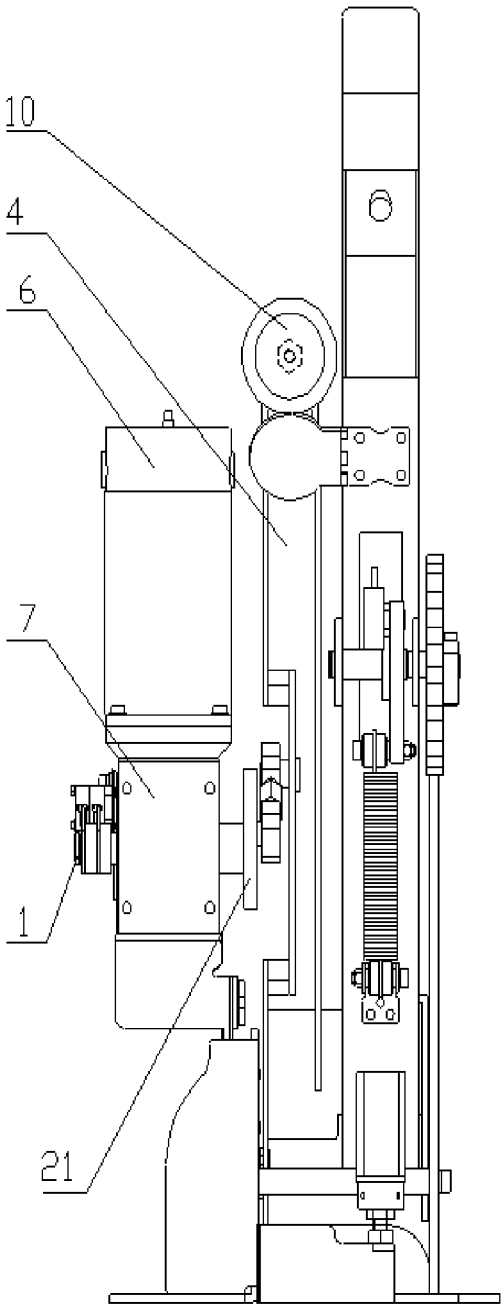
FIG. 2 is a right view of the invention.
Figure 3:
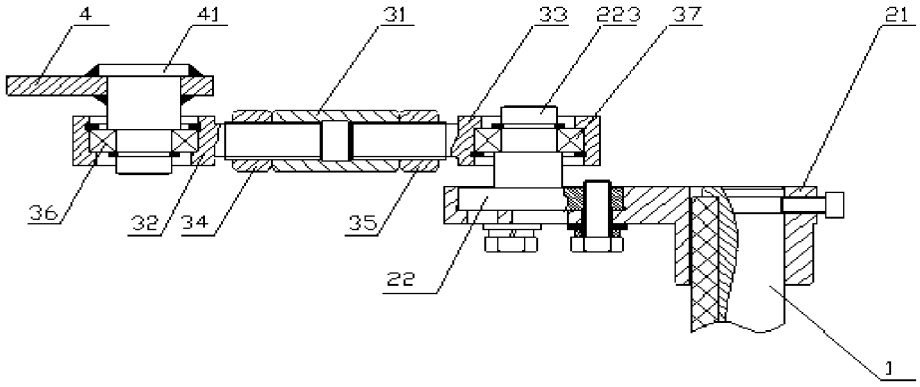
FIG. 3 is a sectional view obtained along the A-A line of the FIG. 1.
Figure 4:
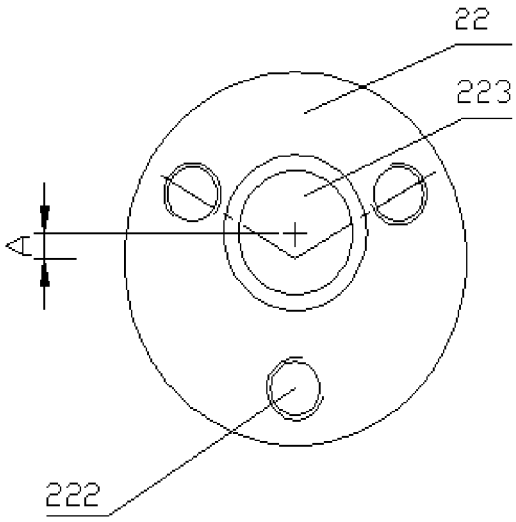
FIG. 4 is an enlarged front view that an eccentric adjusting piece and a small shaft are assembled together.
Figure 5:
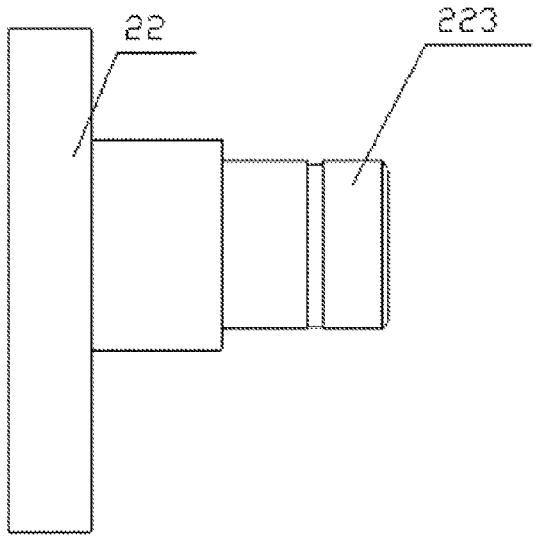
FIG. 5 is an enlarged left view that an eccentric adjusting piece and a small shaft are assembled together.

The embodiments of the invention shall be described in more details with the combination of the drawings and further illustrate the advantages of the invention and its contributions compared to the prior art. As shown in FIG. 1 and FIG. 2, the speed of a motor 6 is reduced through a worm speed reducer 7 so that the motor drives a shaft 1 to be rotated. The shaft 1 drives an eccentric transmission mechanism and a connecting rod mechanism 3 drawing an swing arm 4, and the fixed end of the swing arm 4 is moved around a rotation shaft 8. An electromagnet 10 is arranged on the swing arm 4 and drives a driven swing arm 9 after it is powered on. A gate leaf 5 is mounted on the driven swing arm 9, so as to open or close the gate leaf 5. Generally, when the swing arm 4 is under vertical conditions, the gate leaf has the maximum stroke.

Figure 6:
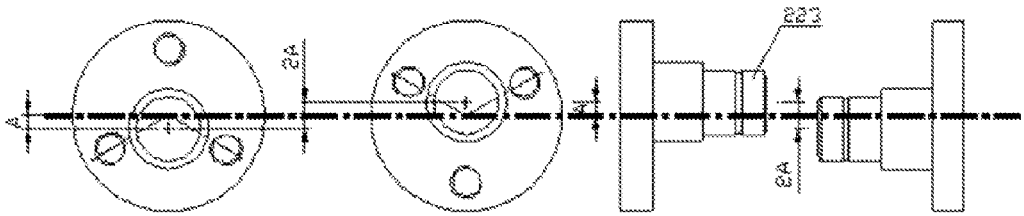
FIG. 6 is a schematic diagram of eccentric amount change.
Figure 7:
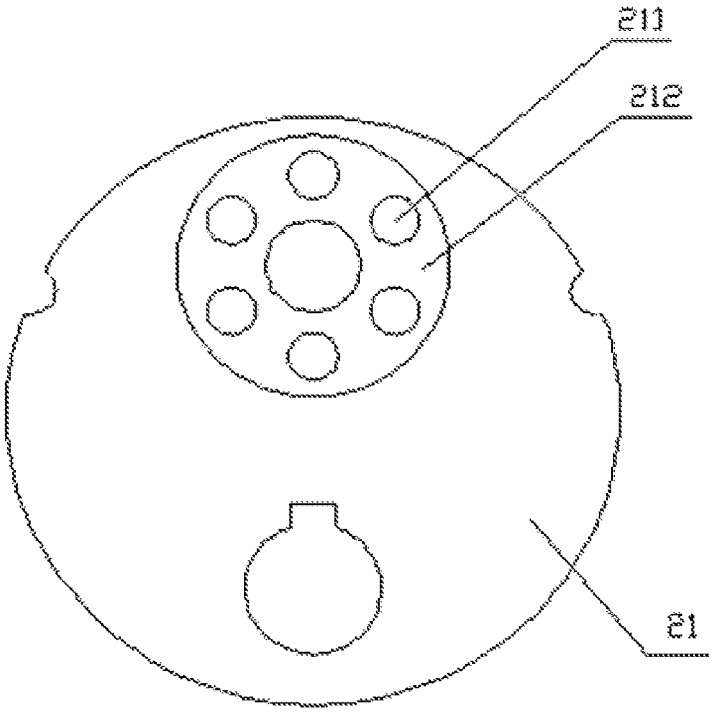
FIG. 7 is an enlarged front view of eccentricity.
Figure 8:
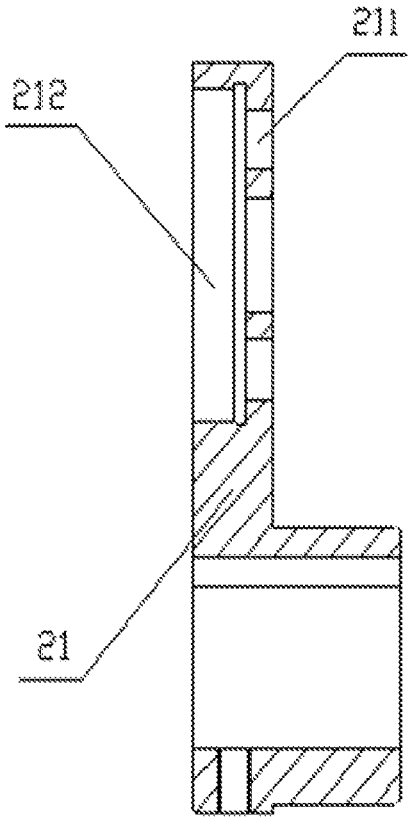
FIG. 8 is an enlarged right view of eccentricity.

Compared with the prior art, the invention mainly improves an eccentric transmission mechanism and a connecting rod mechanism 3. As shown in FIGS. 3, 4, 5, 6, 7 and 8, the shaft 1 and an eccentric disk 21 are fixed and connected through bolts, so as to transmit power. There is one eccentric amount between the axle line of the shaft 1 and the centric point of the eccentric disk 21 and the eccentric amount is unchanged. A round-shaped countersunk head of the eccentric disk 12 provides a mounted base 212 for the flange. The mounted base 212 is provided with six mounting holes 211 of the eccentric disk positioned at the same periphery and spaced by the inclined angle of 60° uniformly. The flange is provided with three flange mounting holes 222 spaced by the inclined angle of 120° and is positioned at the mounted base 212 of the countersunk. The eccentric disk 21 and the flange are fixed and connected together through the bolts. A small shaft 223 is eccentrically fixed on the flange, and there is one eccentric amount A between the axle line of the small shaft and the centric point of the flange. When the mounted place between the flange and the eccentric disk 21 is changed, the distance between the axle lines of the small shaft 223 and the shaft 1 is changed, thus realizing the adjustment for the eccentricity. In the prior art, the eccentric disk 21 is directly welded with the small shaft 223 together, and the eccentric amount is a constant value and cannot be adjusted at this time. The invention is additionally provided with the flange and eccentrically provided with the small shaft 223 again. There is one eccentric amount A between the small shaft 223 and the central point of the flange. The flange is in bolted connection with the eccentric disk 21 through mounting holes. Therefore, only when the mounted place between the flange and the eccentric disk 21 is changed, the eccentric amount can be conveniently changed. The eccentric disk 21 in the invention is provided with six mounting holes 211 of the eccentric disk spaced by the inclined angle of 60°. And then only when the flange is rotated by the angle of 60°, one eccentric amount can be changed. The flange has four places adjusting the eccentricity having respectively the inclined angles of 0°, 60°, 120° and 180°. As shown in FIG. 6, the maximum adjusting value of the eccentric amount is 2 A. Therefore, the eccentric amount in the invention has very big adjusting room and then can be appropriately adapted for adjusting the length of the connecting rod. One end of a traction rod 33 of a right thread is provided with a bearing pedestal to fix a right bearing 37 and sleeved with a small shaft 223, thus facilitating an eccentric adjusting piece 22 and a connecting rod mechanism 3 to be freely connected. The left and the right ends of the adjusting nut 31 are provided with a left thread and a right thread, and the traction rods 32 and 33 of the left and the right threads are respectively connected with the left and the right threads of the adjusting nut 31. The right and the left lock nuts 34 and 35 are arranged between the traction rods 32 and 33 of the left and the right threads and the adjusting nut 31. A traction shaft 41 is welded on a swing arm 4. The traction rod 32 of the left thread is provided with the bearing pedestal to fix the left bearing 36 and sleeved with the traction shaft 41, thereby facilitating the traction rod 3 to be freely connected with the swing arm 4.

With the abovementioned arrangements, the invention adjusts the blocking width of a gate leaf within a certain range through such following steps: A mounting hole of a flange is firstly rotated and fixed on an eccentric disk 21 with bolts after the mounting hole is adjusted to have proper eccentric amount. An adjusting nut 31 is rotated, and the traction rods 32 and 33 of the left and the right threads are moved relatively, so as to increase or decrease the length of a connecting rod. After the length of the connecting rod is adjusted, the left and the right luck nuts 34 and 35 are screwed tightly. With the abovementioned adjustment, the blocking width of the gate leaf is changed and guarantees the gate leaf to be opened or recovered in place. In existing experiments, for example, the blocking width of 900 mm can be adjusted to be 870 mm.

The invention claimed is:

1. A blocking apparatus of a turnstile with an adjustable blocking width of a gate leaf, comprises:

a main shaft (1);

a swing arm (4);

an eccentric disk (21) with six mounting holes (211), wherein the eccentric disk (21) is eccentrically connected with the main shaft (1);

an eccentric adjusting piece (22), which is a flange with three flange mounting holes (222) uniformly distributed and equidistant from the center of the flange, connected with the eccentric disk (21) through the mounting holes (211);

a small shaft (223) fixed eccentrically at the eccentric adjusting piece (22); and a connecting rod mechanism (3), whose length is retractable, connected with the swing arm (4), wherein the six mounting holes (211) are uniformly distributed and equidistant from the center of the eccentric adjusting piece (22).

2. The blocking apparatus according to claim 1, wherein the connecting rod mechanism (3) comprises:

an adjusting nut (31), which has a left and a right end provided with a left thread and a right thread, respectively;

a left traction rod (32) with one end connected with the left thread of the adjusting nut (31), and another end connected with the swing arm (4) of the gate leaf; and a right traction rod (33) with one end connected with the right thread of the adjusting nut (31) and another end connected with the eccentric adjusting piece (22).

3. The blocking apparatus according to claim 2, wherein the connecting rod mechanism (3) further comprises:

a left lock nut (34) installed between the left traction rod (32) of the left thread and the adjusting nut (31);

and a right lock nut (35) installed between the right traction rod (33) of the right thread and the adjusting nut (31).

4. The blocking apparatus according to claim 2, wherein the swing arm (4) is fixed with a traction shaft (41); the left traction rod (32) is fixed with a left bearing (36) sleeved with the traction shaft (41), which facilitates the traction rod (32) of the left thread to be freely connected with the swing arm (4); and the right traction rod (33) is fixed with a right bearing (37) sleeved with the small shaft (223), which facilitates the traction rod (33) of the right thread to be freely connected with the eccentric adjusting piece (22).

* * * * *